US012630893B2

(12) United States Patent
Mizobata et al.

(10) Patent No.: US 12,630,893 B2
(45) Date of Patent: May 19, 2026

(54) DECARBURIZATION REFINING METHOD FOR MOLTEN STEEL UNDER REDUCED PRESSURE

(71) Applicant: JFE STEEL CORPORATION, Tokyo (JP)

(72) Inventors: Keisuke Mizobata, Tokyo (JP); Akifumi Harada, Tokyo (JP); Yoshie Nakai, Tokyo (JP); Rei Yamada, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 774 days.

(21) Appl. No.: 17/914,528

(22) PCT Filed: Mar. 24, 2021

(86) PCT No.: PCT/JP2021/012330

§ 371 (c)(1),
(2) Date: Sep. 26, 2022

(87) PCT Pub. No.: WO2021/200496

PCT Pub. Date: Oct. 7, 2021

(65) Prior Publication Data

US 2023/0142051 A1 May 11, 2023

(30) Foreign Application Priority Data

Apr. 1, 2020 (JP) ..... 2020-065529

(51) Int. Cl.
*C21C 7/068* (2006.01)
*C21C 7/00* (2006.01)
*C21C 7/10* (2006.01)

(52) U.S. Cl.
CPC ..... *C21C 7/068* (2013.01); *C21C 7/0068* (2013.01); *C21C 7/10* (2013.01); *C21C 7/0075* (2013.01); *C21C 2300/06* (2013.01)

(58) Field of Classification Search
CPC ..... C21C 7/068; C21C 7/0068; C21C 7/10; C21C 7/0075; C21C 2300/06; C21C 5/4673; C21C 2005/5288; Y02P 10/20
See application file for complete search history.

(56) References Cited

FOREIGN PATENT DOCUMENTS

CN 103194574 A * 7/2013
CN 103305655 A 9/2013
(Continued)

OTHER PUBLICATIONS

Wei et al., Mathematical modeling of the argon-oxygen decarburization refining process of stainless steel: Part I. Mathematical model of the process, Metallurgical and Materials Transactions B, vol. 33, pp. 111-119, (2002) (Year: 2002).*
(Continued)

*Primary Examiner* — Rebecca Janssen
(74) *Attorney, Agent, or Firm* — Oliff PLC

(57) ABSTRACT

A decarburization refining method for molten steel under reduced pressure. The method includes an oxygen-blowing decarburization and a rimmed decarburization. Using operation data taken at a time when oxygen-blowing decarburization is started and a time when oxygen-blowing decarburization is ended, an amount of carbon removed while the oxygen-blowing decarburization is performed is estimated. Based on the estimated amount of carbon removed, a carbon concentration in molten steel at a time when the rimmed decarburization is started is estimated. Using the estimated value as the carbon concentration in molten steel at the time when the rimmed decarburization is started, a change over time in the carbon concentration in molten steel while the rimmed decarburization is performed is calculated. Based on the calculated change over time in the carbon concentration in molten steel while the rimmed decarburization is per-
(Continued)

formed, a determination is made about a time when the rimmed decarburization is ended.

10 Claims, 1 Drawing Sheet

(56) References Cited

FOREIGN PATENT DOCUMENTS

| | | | | | |
|---|---|---|---|---|---|
| CN | 104169442 | A | | 11/2014 | |
| CN | 104419799 | A | | 3/2015 | |
| CN | 105087857 | A | | 11/2015 | |
| JP | H08260030 | A | * | 10/1996 | |
| JP | 3231555 | B2 | | 11/2001 | |
| JP | 3415997 | B2 | | 6/2003 | |
| JP | 3965008 | B2 | | 8/2007 | |
| JP | 2018-83983 | A | | 5/2018 | |
| KR | 20150073559 | A | * | 7/2015 | ..... C21C 7/10 |
| KR | 101570582 | B1 | | 11/2015 | |
| RU | 2213147 | C2 | | 9/2003 | |
| SU | 697573 | A1 | | 11/1979 | |
| SU | 1399353 | A1 | | 5/1988 | |

OTHER PUBLICATIONS

Zong et al., Theoretical Interpretation of the Decarburization Mechanism in Convective Oxygen Steelmaking, Materials Transactions B, vol. 21B, (1990), pp. 49-57 (Year: 1990).*

Zhang et al., Mathematical Model for Decarburization Process in RH Refining Process, ISIJ International, vol. 54 (2014), No. 7, pp. 1560-1569 (Year: 2014).*

Jun. 8, 2021 International Search Report issued in International Patent Application No. PCT/JP2021/012330.

Jan. 31, 2024 Office Action issued in Chinese Patent Application No. 202180024044.6.

May 11, 2024 Office Action issued in Chinese Patent Application No. 202180024044.6 with concise explanation of relevance.

Oct. 16, 2023 Office Action issued in Korean Patent Application No. 10-2022-7032431.

Nov. 1, 2021 Office Action issued in Taiwanese Patent Application No. 110111765.

Feb. 17, 2023 Office Action issued in Russian Patent Application No. 2022124930.

Jun. 30, 2023 Extended European Search Report issued in European Patent Application No. 21779518.6.

* cited by examiner

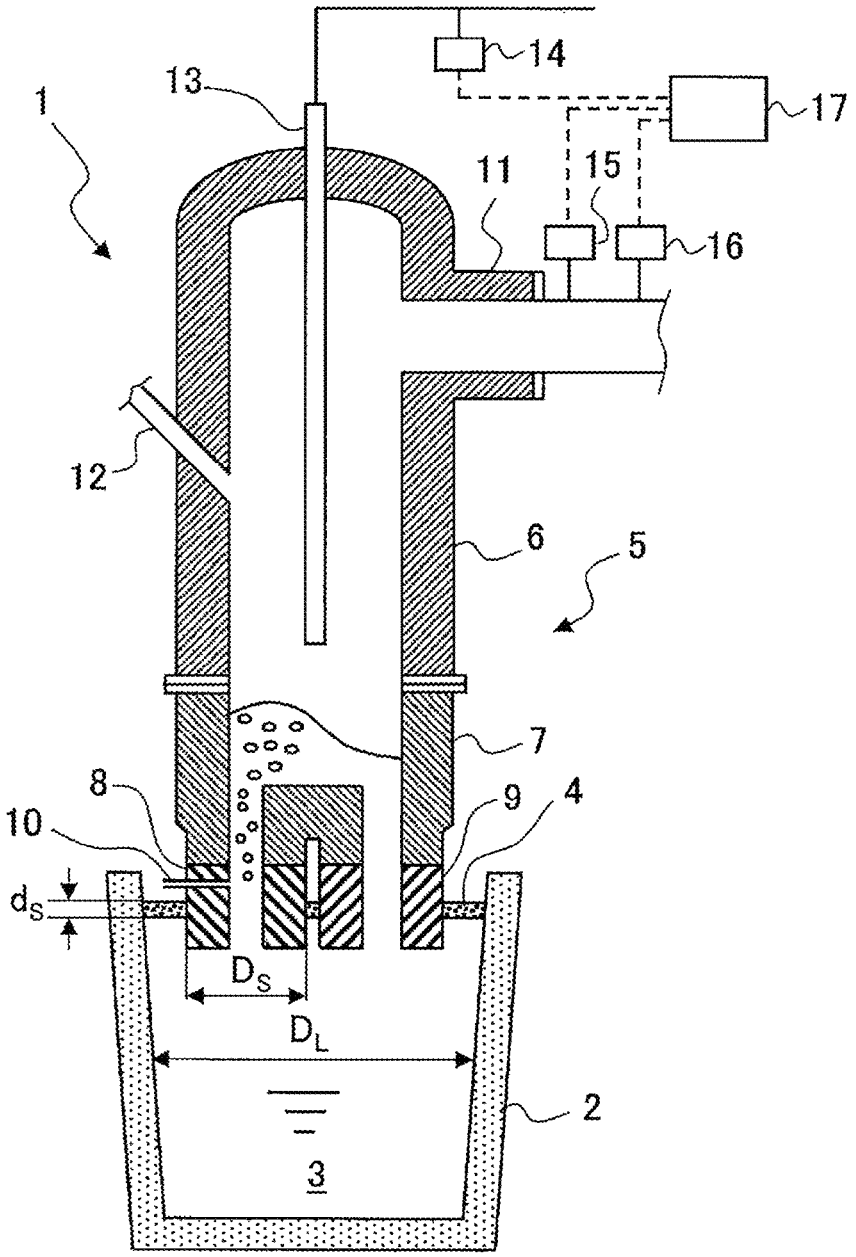
1
13
14
17
11
15
16
12
6
5
7
8
9
4
10
$d_S$
$D_S$
$D_L$
2
3

DECARBURIZATION REFINING METHOD FOR MOLTEN STEEL UNDER REDUCED PRESSURE

TECHNICAL FIELD

This application relates to a decarburization refining method for molten steel under reduced pressure utilizing a vacuum degassing apparatus.

BACKGROUND

Known examples of a vacuum degassing apparatus used for performing decarburization refining on molten steel in a ladle under reduced pressure include apparatuses of various types such as an RH vacuum degasser, a DH vacuum degasser, a REDA vacuum degasser, a VAD vacuum refining apparatus, and the like. Here, a treatment in which decarburization refining is performed on molten steel in a ladle under reduced pressure is also referred to as "vacuum decarburization refining". In response to a trend toward upgrading steel materials and an increase in demand for upgraded steel materials, since there is a trend toward increasing the variety and amount of steel grades for which vacuum decarburization refining is necessary, there is a strong demand for decreasing the time required to perform such a treatment so that there is an improvement in the processing capacity of a vacuum degassing apparatus and so that there is a decrease in tapping temperature in a converter, thereby decreasing the manufacturing costs of a steel material.

When decarburization refining is performed under reduced pressure in a vacuum degassing apparatus, in the case where the determination accuracy of the end of decarburization refining is low, decarburization refining is continued, even though the carbon concentration of molten steel is equal to or lower than a target concentration, which results in vacuum decarburization refining being delayed. Therefore, to rapidly perform vacuum decarburization refining, accurately assessing the carbon concentration in molten steel while vacuum decarburization refining is performed, which changes from moment to moment, is significantly important. However, generally, in the case of a current operation, since an operator intuitively makes a determination about the time of the end of decarburization refining based on the analysis data of an exhaust gas or the like, there is insufficient accuracy.

To remedy such a situation, to date, some techniques for accurately estimating the carbon concentration in molten steel in a ladle in which decarburization refining is being performed under reduced pressure have been proposed.

For example, Patent Literature 1 proposes a method in which the concentrations of CO gas, $CO_2$ gas, and $O_2$ gas in an exhaust gas are analyzed, the obtained analysis values are corrected based on the amount of air leak into a vacuum exhaust system to obtain the CO gas concentration and the $CO_2$ gas concentration, and the carbon content in molten steel is estimated from the corrected CO gas concentration and $CO_2$ gas concentration based on the correlation between the corrected gas concentrations and the carbon content in molten steel which has been obtained in advance.

However, in the case of the method according to Patent Literature 1, due to problems regarding the accuracy of an exhaust gas analyzer and a flowmeter, there is insufficient estimation accuracy of the carbon concentration in an ultralow carbon concentration range in which the carbon concentration in molten steel is 50 mass ppm or lower.

Patent Literature 2 proposes a method for estimating the carbon concentration while decarburization treatment is performed based on a vacuum decarburization reaction model in molten steel, in which a change in pressure Pt in a vacuum chamber is taken online, and the carbon concentration and the oxygen concentration are calculated from moment to moment based on the analysis value of the carbon concentration in a molten steel sample which is taken before vacuum exhaust is started, the temperature T of molten steel which is measured immediately before vacuum exhaust is started, and an oxygen potential [O] which is detected by using an oxygen potential sensor.

However, in the case of the method according to Patent Literature 2, since no consideration is given to the effect of oxygen moving into slag, it is not possible to accurately evaluate an oxygen budget (oxygen balance) while oxygen-blowing decarburization treatment, which involves the formation of FeO due to the oxidation of molten steel, is performed, resulting in a problem of a calculation error occurring.

Patent Literature 3 proposes a method in which the carbon content in molten steel is estimated from the amounts and contents of an exhaust gas from the starting time of a treatment to a certain time when the estimated carbon content in the molten steel reaches a value in a range of 100 mass ppm to 30 mass ppm, and a change in the carbon concentration since such a time is estimated through a calculation utilizing a decarburization model formula.

However, in the case of the method according to Patent Literature 3, since the exhaust gas analysis causes a delay, there is a problem in that it is difficult to determine the carbon concentration in molten steel at the time when the estimation method is changed from the method in which estimation is performed from the amounts and contents of an exhaust gas to the method in which estimation is performed by utilizing the decarburization model formula.

Non-Patent Literature 1 describes a decarburization reaction model for accurately analyzing the decarburization reaction of molten steel in a vacuum degassing furnace in which consideration is given to three elementary processes, that is, mass transfer in a liquid phase, mass transfer in a gas phase, and a chemical reaction rate, and three reactions, that is, internal decarburization, surface decarburization, and bubble decarburization. Here, the term "internal decarburization" denotes a decarburization reaction due to CO gas being generated from inside molten steel having a supersaturation pressure equal to or higher than a certain threshold value, the term "surface decarburization" denotes a decarburization reaction on a free surface exposed to an atmosphere under reduced pressure, and the term "bubble decarburization" denotes a decarburization reaction on the surface of the ascending bubble of a rare gas (argon gas bubble) which is injected into molten steel. However, Non-Patent Literature 1 describes only the general idea regarding analyzing a decarburization reaction in molten steel under reduced pressure and does not propose a specific refining method for, for example, making a determination about the end of decarburization refining at an appropriate time.

CITATION LIST

Patent Literature

PTL 1: Japanese Patent No. 3965008
PTL 2: Japanese Patent No. 3415997
PTL 3: Japanese Patent No. 3231555

Non-Patent Literature

NPL 1: Shinya Kitamura et al.; Tetsu-to-Hagané, vol. 80 (1994), pp. 213-218.

SUMMARY

Technical Problem

As described above, regarding the vacuum decarburization refining of molten steel utilizing a vacuum degassing apparatus, although many methods for estimating the carbon concentration in molten steel while decarburization refining is performed have been proposed to date, all of them have a problem of insufficient accuracy.

The disclosed embodiments have been completed in view of the situation described above, and an object of the disclosed embodiments is to provide a decarburization refining method for molten steel under reduced pressure with which, while decarburization refining is performed on molten steel by using a vacuum degassing apparatus, it is possible to accurately estimate the carbon concentration in the molten steel and to make a determination about the end of the decarburization refining at an appropriate time.

Solution to Problem

The inventors diligently conducted experiments and investigations to solve the problems described above. Incidentally, examples of a vacuum decarburization refining method for molten steel utilizing a vacuum degassing apparatus include the following three methods.

(1); treatment method in which decarburization refining is performed by blowing an oxidizing gas (such as oxygen gas) onto molten steel in a vacuum chamber through a top-blowing lance or the like so that oxygen in the oxidizing gas and carbon in the molten steel react with each other. This treatment method is referred to as "oxygen-blowing decarburization treatment".

(2); treatment method in which decarburization refining is performed, without feeding oxygen sources such as an oxidizing gas or iron oxides into molten steel, by exposing non-deoxidized molten steel (molten steel in the rimmed state), which has not been subjected to deoxidizing, to reduced pressure so that dissolved oxygen in molten steel and carbon in molten steel react with each other due to a change in the equilibrium relation between oxygen in molten steel and carbon in molten steel. This treatment method is referred to as "rimmed decarburization treatment".

(3); treatment method in which decarburization refining is performed by performing the oxygen-blowing decarburization treatment described above in the early stage of vacuum decarburization refining and decarburization refining is performed by performing the rimmed decarburization treatment described above in the late stage of vacuum decarburization refining.

For the disclosed embodiments, experiments and investigations were diligently conducted under the assumption that vacuum decarburization refining is performed by using the treatment method described in (3), which is the most commonly used treatment method. As a result, it was found that, since the amount of carbon removed while the oxygen-blowing decarburization treatment is performed is not accurately estimated, there is a variation in the carbon concentration in molten steel at the time when the rimmed decarburization treatment is started and that, even in the case where there is a variation in the carbon concentration in molten steel at the time when the rimmed decarburization treatment is started, since it is not possible to reflect this fact in the conditions applied for rimmed decarburization treatment, there is no increase in the estimation accuracy of the carbon concentration in molten steel at the time when vacuum decarburization refining is ended or in the determination accuracy of the end of the treatment.

Therefore, the inventors conducted investigations from the viewpoint of more accurately estimating the amount of carbon removed while an oxygen-blowing decarburization treatment is performed and of reflecting the estimated results in determination about the end of a rimmed decarburization treatment, resulting in the completion of the disclosed embodiments. Specifically, it was found that, by deriving the amount of carbon removed while an oxygen-blowing decarburization treatment is performed from an oxygen budget while an oxygen-blowing decarburization treatment is performed, and by calculating the carbon concentration in molten steel by using a decarburization reaction model while a rimmed decarburization treatment following an oxygen-blowing decarburization treatment is performed, it is possible to accurately estimate the carbon concentration in molten steel.

The disclosed embodiments have been completed based on the findings described above, and the subject matter of the disclosed embodiments is as follows.

[1] A decarburization refining method for molten steel under reduced pressure, the method including an oxygen-blowing decarburization treatment of blowing an oxidizing gas onto molten steel under reduced pressure to perform a decarburization treatment and a rimmed decarburization treatment of stopping feeding of oxygen sources including the oxidizing gas to molten steel after the oxygen-blowing decarburization treatment has been performed and of performing a decarburization treatment under reduced pressure until a carbon concentration in the molten steel becomes equal to or lower than a target value, in which, in a heat for which decarburization refining is performed, by using operation data taken at a time when the oxygen-blowing decarburization treatment is started and at a time when the oxygen-blowing decarburization treatment is ended, an amount of carbon removed while the oxygen-blowing decarburization treatment is performed is estimated, in which, based on the estimated amount of carbon removed while the oxygen-blowing decarburization treatment is performed, the carbon concentration in molten steel at a time when the rimmed decarburization treatment is started is estimated, in which, by using the estimated value as the carbon concentration in molten steel at the time when the rimmed decarburization treatment is started, a change over time in the carbon concentration in molten steel while the rimmed decarburization treatment is performed in the relevant heat is calculated, and in which, based on the change over time in the carbon concentration in molten steel while the rimmed decarburization treatment is performed which is calculated, a determination is made about a time when the rimmed decarburization treatment is ended.

[2] The decarburization refining method for molten steel under reduced pressure according to item [1] above, in which, the rimmed decarburization treatment is ended after when the calculated value of the change over time in the carbon concentration in molten steel while the rimmed decarburization treatment is performed has become equal to or lower than the target value of the carbon concentration in molten steel.

[3] The decarburization refining method for molten steel under reduced pressure according to item [1] or [2] above, in which the amount of carbon removed while the oxygen-blowing decarburization treatment is performed is estimated based on an oxygen budget while the oxygen-blowing decarburization treatment is performed in the relevant heat.

[4] The decarburization refining method for molten steel under reduced pressure according to any one of items [1] to [3] above, in which, regarding the oxygen budget while the oxygen-blowing decarburization treatment is performed, an amount of incoming oxygen and an amount of outgoing oxygen are estimated from at least an amount of oxygen gas contained in the oxidizing gas fed while the oxygen-blowing decarburization treatment is performed in the relevant heat, a change in an oxygen content in molten steel between before and after the oxygen-blowing decarburization treatment is performed, and a change in an oxygen content in slag between before and after the oxygen-blowing decarburization treatment is performed, and in which the amount of carbon removed while the oxygen-blowing decarburization treatment is performed is calculated from a difference between the amount of incoming oxygen and the amount of outgoing oxygen.

[5] The decarburization refining method for molten steel under reduced pressure according to item [4] above, in which the change in the oxygen content in slag between before and after the oxygen-blowing decarburization treatment is performed is estimated from a measured value of an oxygen potential of the slag and a measured value of a thickness of the slag which are taken before the oxygen-blowing decarburization treatment is started and a measured value of an oxygen potential of the slag and a measured value of a thickness of the slag which are taken after the oxygen-blowing decarburization treatment has been ended.

[6] The decarburization refining method for molten steel under reduced pressure according to any one of items [1] to [5] above, in which the amount of carbon removed while the oxygen-blowing decarburization treatment is performed is estimated by using equations (1) to (3) below:

[Math. 1]

$$1 = (\Delta O_C + \Delta O_O + \Delta O_S + \zeta O_{Exh})/F_{O_2} \quad (1)$$

$$O_{Exh} = G_{CO_2} \times \frac{16}{44} + G_{O_2} \quad (2)$$

$$\Delta C = \Delta O_C \times \frac{12}{16} \quad (3)$$

Here, $\Delta O_C$ denotes an amount of oxygen (kg) which contributes to decarburizing molten steel while the oxygen-blowing decarburization treatment is performed, $\Delta O_O$ denotes a change in an amount of dissolved oxygen (kg) in molten steel while the oxygen-blowing decarburization treatment is performed, $\Delta O_S$ denotes a change in an amount of oxygen (kg) in slag while the oxygen-blowing decarburization treatment is performed, $O_{Exh}$ denotes an amount of oxygen (kg) which is fed and thereafter discharged into an exhaust system in a form of oxygen or carbon dioxide while the oxygen-blowing decarburization treatment is performed, $F_{O2}$ denotes an amount of oxygen (kg) which is fed while the oxygen-blowing decarburization treatment is performed, $G_{CO2}$ denotes an amount of carbon dioxide (kg) in an exhaust gas while the oxygen-blowing decarburization treatment is performed, $G_{O2}$ denotes an amount of oxygen (kg) in an exhaust gas while the oxygen-blowing decarburization treatment is performed, $\Delta C$ denotes an amount of carbon (kg) removed from molten steel while the oxygen-blowing decarburization treatment is performed, and $\zeta$ denotes a correction factor (−) of an exhaust gas flow rate.

[7] The decarburization refining method for molten steel under reduced pressure according to any one of items [1] to [6] above, in which, while the rimmed decarburization treatment is performed, the change over time in the carbon concentration in molten steel is calculated by using calculation parameters including at least a reaction interface area for surface decarburization, and in which the reaction interface area for surface decarburization is derived and updated based on operation data from moment to moment while the rimmed decarburization treatment is performed.

[8] The decarburization refining method for molten steel under reduced pressure according to item [7] above, in which at least a CO concentration in an exhaust gas is used as the operation data from moment to moment for deriving the reaction interface area for surface decarburization while the rimmed decarburization treatment is performed.

[9] The decarburization refining method for molten steel under reduced pressure according to item [7] above, in which at least a CO concentration in an exhaust gas, a $CO_2$ concentration in an exhaust gas, an $O_2$ concentration in an exhaust gas, and a temperature of molten steel are used as the operation data from moment to moment for deriving the reaction interface area for surface decarburization while the rimmed decarburization treatment is performed.

[10] The decarburization refining method for molten steel under reduced pressure according to item [9] above, in which the reaction interface area for surface decarburization while the rimmed decarburization treatment is performed is derived by using equations (4) to (10) below:

[Math. 2]

$$A_s = \alpha \times \prod \quad (4)$$

$$\prod = (A_{NA} + \beta A_A) \cdot \varepsilon_Q^{1/2} / (W/1000) \quad (5)$$

$$\varepsilon_Q = Q \cdot v^2 / 2W \quad (6)$$

$$Q = 190 \times G^{1/3} \times D^{4/3} \times \{\ln(P_0/P)\}^{1/3} \quad (7)$$

$$v = \frac{Q}{\rho_m} \times \frac{1}{\pi (D/2)^2} \quad (8)$$

$$\beta = \gamma \times \frac{P_{CO}}{760} \times 10^{-(1160/T+2.003)} \quad (9)$$

$$P_{CO} = P \times \left\{ \left( c_{CO_gas} + c_{CO_2_gas} \times \frac{28}{44} \right) \times \frac{1}{100 - c_{O_gas}} \right\} \quad (10)$$

Here, $A_S$ denotes a reaction interface area ($m^2$) for surface decarburization, $\Pi$ denotes a surface reaction rate factor, $\alpha$ denotes a constant (3 to 15), $A_{NA}$ denotes an area ($m^2$) calculated by subtracting a cross-sectional area of an up-leg snorkel from a cross sectional area of a lower chamber, $\beta$ denotes a liquidus surface activity coefficient, $A_A$ denotes a cross-sectional area ($m^2$) of an up-leg snorkel, $\varepsilon_Q$ denotes an agitation power density (W/kg), W denotes an amount of molten steel (kg), Q denotes a circulation flow rate (kg/s) of molten steel, v denotes an injection flow velocity (m/s) of molten steel through a down-leg snorkel, G denotes a flow rate (NL/min) of a circulation flow gas, D denotes an inner diameter (m) of an up-leg snorkel, $P_0$ denotes atmospheric pressure (torr), P denotes pressure (torr) in a vacuum chamber, $\rho_m$ denotes a density (kg/m$^3$) of molten steel, $\gamma$ denotes a proportional constant ($1\times10^4$ to $1\times10^5$), $P_{CO}$ denotes a partial pressure of CO gas in an atmosphere of a vacuum chamber, T denotes a temperature (K) of molten steel, $c_{CO_gas}$ denotes a CO gas concentration (mass %) in an exhaust gas, and $c_{CO2_gas}$ denotes a $CO_2$ gas concentration (mass %) in an exhaust gas.

Advantageous Effects

According to the disclosed embodiments, when vacuum decarburization refining is performed on molten steel by using a vacuum degassing apparatus, since it is possible to accurately estimate the carbon concentration in molten steel and to thereby make a determination about the time when decarburization is ended at an appropriate time, it is possible to decrease the time required to perform vacuum decarburization refining.

BRIEF DESCRIPTION OF THE DRAWINGS

The FIGURE is a schematic longitudinal sectional view of one example of an RH vacuum degasser.

DETAILED DESCRIPTION

Hereafter, the disclosed embodiments will be specifically described.

The decarburization refining method for molten steel under reduced pressure according to the disclosed embodiments is a decarburization refining method under reduced pressure including an oxygen-blowing decarburization treatment of blowing an oxidizing gas onto molten steel under reduced pressure to perform a decarburization treatment and a rimmed decarburization treatment of stopping feeding of oxygen sources including the oxidizing gas to the molten steel after the oxygen-blowing decarburization treatment has been performed and of performing a decarburization treatment under reduced pressure until the carbon concentration in the molten steel becomes equal to or lower than a target value. In addition, in a heat for which decarburization refining is performed, by using operation data taken at the time when the oxygen-blowing decarburization treatment is started and at the time when the oxygen-blowing decarburization treatment is ended, the amount of carbon removed while the oxygen-blowing decarburization treatment is performed is estimated, and, based on the estimated amount of carbon removed while the oxygen-blowing decarburization treatment is performed, the carbon concentration in molten steel at the time when the rimmed decarburization treatment is started is estimated. By using the estimated value as the carbon concentration in molten steel at the time when the rimmed decarburization treatment is started, a change over time in the carbon concentration in molten steel while the rimmed decarburization treatment is performed in the relevant heat is calculated, and, based on the change over time in the carbon concentration in molten steel while the rimmed decarburization treatment is performed which is calculated as described above, a determination is made about the time when the rimmed decarburization treatment is ended.

Examples of a vacuum degassing apparatus in which it is possible to use the decarburization refining method for molten steel under reduced pressure according to the disclosed embodiments include an RH vacuum degasser, a DH vacuum degasser, a REDA vacuum degasser, a VAD vacuum refining apparatus, and the like, and, of these apparatuses, an RH vacuum degasser is the most representative apparatus. Therefore, first, a vacuum degassing refining method in an RH vacuum degasser will be described.

The FIGURE is a schematic longitudinal sectional view of one example of an RH vacuum degasser. In the FIGURE, reference 1 denotes an RH vacuum degasser, reference 2 denotes a ladle, reference 3 denotes molten steel, reference 4 denotes refining slag, reference 5 denotes a vacuum chamber, reference 6 denotes an upper chamber, reference 7 denotes a lower chamber, reference 8 denotes an up-leg snorkel, reference 9 denotes a down-leg snorkel, reference 10 denotes a circulation flow-gas blowing pipe, reference 11 denotes a duct, reference 12 denotes a material-feeding port, and reference 13 denotes a top-blowing lance. Reference 14 denotes an oxidizing gas flowmeter for measuring the flow rate of an oxidizing gas which is fed through the top-blowing lance, reference 15 denotes an exhaust gas flowmeter for measuring the flow rate of an exhaust gas which is discharged through the duct, and reference 16 denotes a gas analyzer for measuring the concentrations of the constituents (CO gas, $CO_2$ gas, and $O_2$ gas) of an exhaust gas which is discharged through the duct. Reference 17 denotes a storage-arithmetic device which stores operation data input from the oxidizing gas flowmeter 14, the exhaust gas flowmeter 15, the gas analyzer 16, and the like and which performs calculations by using such operation data and equations (1) to (24) below. In addition, DL denotes the average internal diameter of the ladle, $D_S$ denotes the external diameter of the up-leg snorkel and the down-leg snorkel, and $d_S$ denotes the thickness of the slag.

The vacuum chamber 5 is composed of the upper chamber 6 and the lower chamber 7, and the top-blowing lance 13 is a device through which an oxidizing gas and a flux are blown onto and added to the molten steel in the vacuum chamber, which is disposed in the upper part of the vacuum chamber 5 and which is vertically movable in the vacuum chamber 5.

In the RH vacuum degasser 1, the ladle 2 containing the molten steel 3 is elevated by using an elevator (not illustrated), and the up-leg snorkel 8 and the down-leg snorkel 9 are submerged in the molten steel 3 in the ladle. In addition, while the inside of the vacuum chamber 5 is evacuated through an exhaust device (not illustrated) connected to the duct 11 to reduce the pressure inside the vacuum chamber 5, a circulation flow gas is blown into the up-leg snorkel 8 through the circulation flow-gas blowing pipe 10. When the pressure inside the vacuum chamber 5 is reduced, the molten steel 3 in the ladle ascends in proportion to a difference between the atmospheric pressure and the pressure inside the vacuum chamber (degree of vacuum) and flows into the vacuum chamber. In addition, due to a gas lift effect resulting from the circulation flow gas blown through the circulation flow-gas blowing pipe 10, the molten steel 3 in the ladle ascends inside the up-leg snorkel 8 with the circulation flow gas and flows into the vacuum chamber 5. The molten steel 3 which flows into the vacuum chamber 5 due to the pressure difference and the gas lift effect returns into the ladle 2 through the down-leg snorkel 9. The flow of the molten steel, in which the molten steel flows from the ladle 2 into the vacuum chamber 5 and thereafter returns from the vacuum chamber 5 into the ladle 2, is referred to as "circulation flow", and, as a result of the molten steel 3 forming the circulation flow, the molten steel 3 is subjected to RH vacuum degassing refining.

As a result of the molten steel 3 being exposed to the atmosphere under reduced pressure in the vacuum chamber, since hydrogen and nitrogen contained in the molten steel move from the molten steel 3 into the atmosphere in the vacuum chamber, the molten steel 3 is subjected to a dehydrogenation treatment and a denitrification treatment. In addition, in the case where the molten steel 3 is in the non-deoxidized state, as a result of the molten steel being exposed to the atmosphere under reduced pressure, since carbon in the molten steel and dissolved oxygen in the molten steel react with each other to form CO gas, and since the formed CO gas moves into the atmosphere in the vacuum chamber, a decarburization reaction progresses in the molten steel 3. This decarburization reaction corresponds to a rimmed decarburization treatment.

In the decarburization refining method for molten steel under reduced pressure according to the disclosed embodiments, in the early stage of the vacuum decarburization refining, by blowing an oxidizing gas through the top-blowing lance 13 onto molten steel 3 in the non-deoxidized state in the vacuum chamber, an oxygen-blowing decarburization treatment is performed. Since carbon in the molten steel reacts with oxygen in the oxidizing gas fed through the top-blowing lance 13 to form CO gas, and since the formed CO gas moves into the atmosphere in the vacuum chamber, a decarburization reaction progresses in the molten steel 3. Examples of an oxidizing gas blown through the top-blowing lance 13 include oxygen gas (industrial pure oxygen gas), a mixture of oxygen gas and an inert gas, oxygen-enriched air, and the like. Due to the oxidizing gas being fed through the top-blowing lance 13, there is an increase in the dissolved oxygen concentration in the molten steel.

Subsequently, not only by stopping blowing of an oxidizing gas through the top-blowing lance 13, but also by stopping feeding of oxygen sources such as iron oxides into the molten steel 3, a transition is made to a rimmed decarburization treatment under reduced pressure. In the rimmed decarburization treatment, a rimmed decarburization treatment is continued until the carbon concentration in the molten steel becomes equal to or lower than a target value, and a deoxidizing agent such as metal aluminum is added to the molten steel 3 after the time when the carbon concentration in molten steel becomes equal to or lower than the target value so that the rimmed decarburization treatment is ended. Since there is a decrease in the amount of dissolved oxygen in the molten steel due to the addition of the deoxidizing agent such as metal aluminum, the rimmed deoxidization treatment is ended.

In relation to vacuum decarburization refining for molten steel, in which a vacuum degassing apparatus such as an RH vacuum degasser is used and in which carbon in the molten steel is removed by refining the molten steel under reduced pressure, the inventors conducted investigations regarding accurately estimating an oxygen budget in the stage of the oxygen-blowing decarburization treatment performed in the early stage of vacuum decarburization refining. As a result, the inventors devised a method in which the amount of carbon removed is calculated based on an oxygen budget which is estimated from operation data regarding not only dissolved oxygen in the molten steel and oxygen in an oxidizing gas used in a decarburization reaction but also oxygen contained in slag 4 in the form of FeO, MnO, and the like. It was found that, by estimating an oxygen budget by using such a method, it is possible to accurately estimate the carbon concentration in the molten steel after the oxygen-blowing decarburization treatment has been performed.

To date, although attempts have been made to estimate the amount of carbon removed by using a carbon budget in an exhaust gas as described above (for example, refer to Patent Literature 1), no attempt has been made to estimate the amount of carbon removed by using an oxygen budget. This is because, in the method for estimating the amount of carbon removed by using an oxygen budget, since it is necessary that oxygen activity in molten steel be continuously measured, and since there is no appropriate method for continuously measuring oxygen activity, it is not possible to continuously estimate the amount of carbon removed, and, therefore, it is not possible to use such a method for determining the end of decarburization. In addition, it is not possible to use a method in which the amount of carbon removed is estimated by using a carbon budget in an exhaust gas for determining the end of decarburization, because such a method has insufficient accuracy in the case where the carbon concentration in molten steel is in an ultralow carbon concentration range of 50 mass ppm or less.

Therefore, to estimate the carbon concentration in molten steel while the rimmed decarburization treatment involving an ultralow carbon concentration range is performed, use of a decarburization reaction model is effective. However, in the case where the amount of carbon removed is estimated by using a decarburization reaction model, when calculation is performed including the stage of the oxygen-blowing decarburization treatment, since there is a variation in the contents of blown oxygen consumption (decarburization reaction, secondary combustion, slag oxidation, and exhaust) between heats, there is a problem of a decrease in estimation accuracy.

However, as described below, by directly measuring the oxygen content in slag in the middle of the oxygen-blowing decarburization treatment, it is possible to accurately evaluate the contents of blown oxygen consumption including the amount of oxygen consumed for decarburization while the oxygen-blowing decarburization treatment is performed. In the disclosed embodiments, the time when the oxygen-blowing decarburization treatment is ended is clearly defined by utilizing a change in the oxygen concentration in an exhaust gas, and such a time is set to be identical to the time when the oxygen content in slag is directly measured and to the time when a transition is made to the carbon concentration estimation utilizing a decarburization reaction model. Consequently, since it is possible to eliminate the effect of a variation in the contents of blown oxygen consumption, it is possible to decrease the estimation error.

Hereafter, the method for estimating the amount of carbon removed in the stage of the oxygen-blowing decarburization treatment based on the oxygen budget considering oxygen used for forming slag 4 will be described.

The oxygen budget while the oxygen-blowing decarburization treatment is performed is expressed by equations (1) and (2) below.

[Math. 3]

$$1 = (\Delta O_C + \Delta O_O + \Delta O_S + \zeta O_{Exh})/F_{O_2} \quad (1)$$

$$O_{Exh} = G_{CO_2} \times \frac{16}{44} + G_{O_2} \quad (2)$$

Here, $\Delta O_C$ denotes the amount of oxygen (kg) which contributes to decarburizing molten steel while the oxygen-blowing decarburization treatment is performed, $\Delta O_O$ denotes a change in the amount of dissolved oxygen (kg) in molten steel while the oxygen-blowing decarburization treatment is performed, $\Delta O_S$ denotes a change in the amount of oxygen (kg) in slag while the oxygen-blowing decarburization treatment is performed, $O_{Exh}$ denotes the amount of oxygen (kg) which is fed and thereafter discharged into an exhaust system in the form of oxygen or carbon dioxide while the oxygen-blowing decarburization treatment is performed, $F_{O2}$ denotes the amount of oxygen (kg) which is fed while the oxygen-blowing decarburization treatment is performed, $G_{CO2}$ denotes the amount of carbon dioxide (kg) in an exhaust gas while the oxygen-blowing decarburization treatment is performed, $G_{O2}$ denotes the amount of oxygen (kg) in an exhaust gas while the oxygen-blowing decarburization treatment is performed, $\Delta C$ denotes the amount of carbon (kg) removed from molten steel while the oxygen-blowing decarburization treatment is performed, and $\zeta$ denotes the correction factor (−) of an exhaust gas flow rate.

The correction factor ($\zeta$) is determined based on past records so that the left-hand side of equation (1) is equal to the right-hand side of equation (1). For example, the value of $\zeta$ may be determined by performing plural test heats for determining the value of $\zeta$, by determining the value of $\zeta$ for each of the heats so that the left-hand side of equation (1) is equal to the right-hand side of equation (1), and by defining the value of $\zeta$ used for a practical operation as the average value of $\zeta$ for the respective heats. Here, it is preferable that the number of heats for determining the value of $\zeta$ be at least five. Alternatively, the value of $\zeta$ may be determined for each heat so that a difference between the calculated carbon concentrations in molten steel for determining the end of the treatment and the recorded carbon concentrations in molten steel in several heats (5 to 50 heats) immediately before the relevant heat is minimized. Although the value of $\zeta$ obtained as described above is about 0.2 to 2.0 in the case of the tests performed by the inventors, the value of $\zeta$ is not limited to such values, and the value of $\zeta$ may be appropriately determined.

Here, each of $\Delta O_O$ and $\Delta O_S$ is defined so that such a parameter takes a positive value in the case where the corresponding value after the oxygen-blowing decarburization treatment has been performed is larger than the value before the oxygen-blowing decarburization treatment is performed. In addition, in equation (2), the first term of the right-hand side denotes the amount of oxygen used for oxidizing CO gas through secondary combustion. This is because, since CO gas is generated and no $CO_2$ gas is generated in a decarburization reaction, $CO_2$ gas in an exhaust gas is generated through the secondary combustion of CO gas.

Regarding the oxygen budget in the case where there is an increase in the amounts of dissolved oxygen in molten steel and oxygen in slag while the oxygen-blowing decarburization treatment is performed, in equation (1), the amount of incoming oxygen is equal to the amount of oxygen gas contained in the oxidizing gas fed through the top-blowing lance while the oxygen-blowing decarburization treatment is performed. In addition, it may be considered that the amount of outgoing oxygen is equal to the sum of the amount of oxygen $\Delta O_C$ which contributes to decarburizing molten steel, a change in the amount of dissolved oxygen in molten steel $\Delta O_O$, a change in the amount of oxygen in slag Aos, and the amount of oxygen $O_{Exh}$ which is discharged into an exhaust system in the form of oxygen or carbon dioxide. In this case, each of the amount of change $\Delta O_O$ and the amount of change $\Delta O_S$ means the amount of increase.

A change in the amount of dissolved oxygen $\Delta O_O$ is obtained by measuring the oxygen potential of molten steel in a ladle by using an oxygen measurement probe before and after the oxygen-blowing decarburization treatment is performed.

A change in the amount of oxygen in slag Aos is obtained by measuring the oxygen concentration $c_{o_1}$ (mass %) in slag before oxygen-blowing is started, the thickness of slag $d_{s_1}$ (m) before oxygen-blowing is started, the oxygen concentration $c_{o_2}$ (mass %) in slag after oxygen-blowing has been ended, and the thickness of slag $d_{s_2}$ (m) after oxygen-blowing has been ended, and by using equation (11) below.

[Math. 4]

$$\Delta O_s = \left\{\left(\frac{c_{o_2}}{100} \times d_{s_2}\right) - \left(\frac{c_{o_1}}{100} \times d_{s_1}\right)\right\} \times \left(\frac{\pi D_L^2}{4} - 2\frac{\pi D_s^2}{4}\right) \times \rho_s \tag{11}$$

Here, $c_{o_1}$ denotes the oxygen concentration (mass %) in slag before oxygen-blowing is started, $c_{o_2}$ denotes the oxygen concentration (mass %) in slag after oxygen-blowing has been ended, $d_{s_1}$ denotes the thickness of slag (m) before oxygen-blowing is started, $d_{s_2}$ denotes the thickness of slag (m) after oxygen-blowing has been ended, $D_L$ denotes the average ladle internal diameter (((top end diameter)+(bottom end diameter))/2, unit: m), $D_S$ denotes the external diameter (m) of a snorkel, and $\rho_s$ denotes the density (kg/m$^3$) of slag.

The oxygen concentration $c_{o_1}$ in slag and the oxygen concentration $c_{o_2}$ in slag are defined by equation (12) below. In equation (12), $c_{o_1,2}$ denotes one of the oxygen concentration $c_{o_1}$ in slag and the oxygen concentration $c_{o_2}$ in slag.

[Math. 5]

$$c_{o_1,2} = \sum_{1}^{n}\left(X_i \times \frac{m_{i,o}}{m_{i,all}}\right) \tag{12}$$

Here, $X_i$ denotes the concentration (mass %) in slag of constituent No. i of slag formed in the stage of the oxygen-blowing decarburization treatment, $m_{i,all}$ denotes the molecular weight of constituent No. i of slag, and $m_{i,O}$ denotes the total atomic weight of oxygen in the molecular weight of constituent No. i of slag. The expression "constituent No. i" denotes the kind of metal oxide which is contained in slag and which is a constituent formed in the stage of the oxygen-blowing decarburization treatment, and, specifically, examples of such a constituent include Fe, $Fe_2O_3$, MnO, $Al_2O_3$, $SiO_2$, $TiO_2$, and the like. Since a metal oxide which is formed mainly in the stage of the oxygen-blowing decarburization treatment is FeO, it is necessary that the meaning of "constituent No. i" include FeO. Since a change (increase) in the amounts of oxides other than FeO is less than a change in the amount of FeO, it is acceptable even in the case where the meaning of "constituent No. i" does not include such oxides. However, it is preferable that the meaning of "constituent No. i" include such oxides.

Each of the thickness $d_{s_1}$ of slag and the thickness $d_{s_2}$ of slag may be derived by submerging a metal bar in molten steel and by physically measuring the height (thickness) of a slag layer adhering to the metal bar, or, alternatively, may be derived by using a level sensor or an eddy-current sensor. In addition, the oxygen concentration in slag may be derived by directly measuring the oxygen potential of refining slag by using a solid electrolyte sensor, or, alternatively, may be derived by taking a slag sample and by analyzing the slag sample. In the case where the solid electrolyte sensor is used, under the assumption that metal oxides expressed by "constituent No. i" are FeO and Mno, the FeO concentration and the MnO concentration in slag are derived, and the oxygen concentration $c_{o_1}$ in slag and the oxygen concentration $c_{o_2}$ in slag are calculated by using equation (12). In the case where the analyzing method is used, the chemical composition of a slag sample is analyzed, $X_i$ corresponding to each of the oxides is derived from the analysis results, and the oxygen concentration $c_{o_1}$ in slag and the oxygen concentration $c_{o_2}$ in slag are calculated by using equation (12).

The amount of oxygen $O_{Exh}$ which is discharged into an exhaust system is derived by measuring an exhaust gas flow rate, the $CO_2$ gas concentration in an exhaust gas, and the $O_2$ gas concentration in an exhaust gas by using the exhaust gas flowmeter 15 and the gas analyzer 16 and by calculating the amount of oxygen from the product of the flow rate and the concentrations. However, since the exhaust gas flow rate which is measured by using the exhaust gas flowmeter 15 contains measurement errors due to device conditions regarding leak or the like, the amount of oxygen is multiplied by the correction coefficient (which is determined based on recorded mass balances of carbon and oxygen in an exhaust gas in heats immediately before the relevant heat.

The amount of oxygen fed $F_{O2}$ is calculated by multiplying the flow rate measured by using the oxidizing gas flowmeter 14 by the oxygen concentration in the oxidizing gas.

By substituting $\Delta O_O$, $\Delta O_S$, $O_{Exh}$, and $F_{O2}$, which are derived by using the methods described above, into equation (1), the amount of oxygen $\Delta O_C$ used for decarburization while the oxygen-blowing decarburization treatment is performed is derived.

Here, $G_{O2}$ in equation (2), which is used when $O_{Exh}$ is calculated, is calculated, in consideration of atmospheric oxygen leak into the exhaust system, by defining the base oxygen concentration as the oxygen concentration in an exhaust gas at the time when oxygen-blowing is not performed, by defining the amount of oxygen in an exhaust gas as the integrated value of the product of an increase in the oxygen concentration from the base oxygen concentration while oxygen-blowing is performed and an exhaust gas flow rate, and by using equation (13) below.

[Math. 6]

$$G_{O_2} = \int_{t_s}^{t_e} \left\{ Q_G \times \frac{(c_{o_gas} - c_{o_base})}{100} \right\} dt \tag{13}$$

Here, $Q_G$ denotes an exhaust gas flow rate (kg/sec), $c_{o_gas}$ denotes the oxygen concentration (mass %) in an exhaust gas, $c_{o_base}$ denotes the oxygen concentration (mass %) in an exhaust gas at the time when oxygen-blowing is not performed, $t_s$ denotes the time when the oxygen-blowing decarburization treatment is started, and the denotes the time when the oxygen-blowing decarburization treatment is ended. Here, $t_s$ is defined as the time when the pressure in the vacuum chamber reaches 300 torr (39.9 kPa) or lower after the vacuum degassing treatment has been started, and the is defined as the time when ($c_{o_gas}/c_{o_base}$) reaches 1.05 or lower after oxygen-blowing has been ended.

Since oxygen used for decarburization is discharged from molten steel in the form of CO gas, ΔC while the oxygen-blowing decarburization treatment is performed is derived by using equation (3) below.

[Math. 7]

$$\Delta C = \Delta O_C \times \frac{12}{16} \tag{3}$$

Here, ΔC denotes the amount of carbon (kg) removed from molten steel while the oxygen-blowing decarburization treatment is performed.

In the case where there is an increase in the amounts of dissolved oxygen in molten steel and oxygen in slag while the oxygen-blowing decarburization treatment is performed, the amount of outgoing oxygen while the oxygen-blowing decarburization treatment is performed is, as expressed by equation (1), equal to the sum of the amount of oxygen $\Delta O_C$ which contributes to decarburizing molten steel, a change in the amount of dissolved oxygen in molten steel $\Delta O_O$, a change in the amount of oxygen in slag Aos, and the amount of oxygen $O_{Exh}$ which is discharged into an exhaust system in the form of oxygen or carbon dioxide. By calculating all of such amounts as outgoing oxygen, it is possible to accurately calculate the amount of carbon removed from molten steel ΔC. It is also possible to calculate the amount of carbon removed from molten steel ΔC by using a simple method, and, in this case, it is important that the amount of outgoing oxygen while the oxygen-blowing decarburization treatment is performed be calculated as the sum of at least a change in the amount of oxygen in molten steel $\Delta O_O$ and a change in the amount of oxygen in slag Aos between before and after the oxygen-blowing decarburization treatment is performed.

After tapping from the converter has been performed, by taking a molten steel sample at some time before a vacuum decarburization refining treatment is started, and by analyzing the carbon concentration in the taken molten steel sample, it is possible to derive the carbon concentration in molten steel $[C]_0'$ at the time when the oxygen-blowing decarburization is ended from a difference between the analyzed value and the amount of carbon removed ΔC. Although the molten steel sample may be taken at any time after tapping from the converter has been performed and before a vacuum decarburization refining treatment is started without causing any problem, it is preferable that the molten steel sample be taken within 3 minutes before a vacuum decarburization refining treatment is started.

By substituting the carbon concentration in molten steel $[C]_0'$ at the time when the oxygen-blowing decarburization treatment is ended, derived as described above, into the decarburization reaction model formulae expressed by equations (14) to (17) below as an initial value, it is possible to estimate a change over time in the carbon concentration in molten steel while the rimmed decarburization treatment is performed compared with the time when the oxygen-blowing decarburization treatment was ended. Here, the time when the rimmed decarburization treatment is started is defined as the time when the oxygen-blowing decarburization treatment is ended, and the time when the rimmed decarburization treatment is ended is defined as the time when a deoxidizing agent is added. Here, the decarburization reaction model formulae are not limited to ones expressed by equations (14) to (17), and other model formulae may be used.

[Math. 8]

$$-d[C]/dt = K([C] - [C]_E) \tag{14}$$

$$d[O] = (16/12) \cdot d[C] \tag{15}$$

$$[O] = [O]' - d[O] \tag{16}$$

$$[C]_E = \{P_{CO}/f_C(f_O \cdot [O])\} \times 10^{-(1160/T+2.003)} \tag{17}$$

Here, [C] denotes the carbon concentration (mass %) in molten steel in the ladle, $[C]_E$ denotes the equilibrium carbon concentration (mass %) in molten steel in the vacuum chamber, K denotes a decarburization rate constant (1/s), t denotes the elapsed time(s) from the time when the oxygen-blowing decarburization treatment was ended, [O] denotes the oxygen concentration (mass %) in molten steel in the ladle, [O]' denotes the oxygen concentration (mass %) in molten steel in the ladle one step before, $P_{CO}$ denotes the partial pressure (torr) of CO gas in the atmosphere of the vacuum chamber, fc denotes the activity coefficient (−) of carbon in molten steel, $f_C$ denotes the activity coefficient (−) of oxygen in molten steel, and T denotes the temperature (K) of molten steel.

For the decarburization rate constant (K), although a value which has been determined in advance based on past treatment records regarding similar steel grades may be used, as described below, it is preferably be calculated by using parameters including a reaction interface area for surface decarburization which is updated appropriately. By using such a reaction interface area for surface decarburization in the calculation, it is possible to estimate more accurately the carbon concentration in molten steel while the rimmed decarburization treatment is performed. Hereafter, the method for such a calculation will be described.

According to Non-Patent Literature 1, a decarburization reaction is divided into major three reactions, that is, internal decarburization, surface decarburization, and bubble decarburization, and the decarburization rate constant (K) is expressed by equation (18) below.

[Math. 9]

$$K = \frac{ak_1 \cdot A + ak_S \cdot A_S + ak_B \cdot A_B}{W/\rho_m} \tag{18}$$

Here, K denotes the decarburization rate constant (1/s), $ak_I$ denotes the reaction capacity coefficient ($m^3$/s) of internal decarburization, A denotes the cross-sectional area ($m^2$) of the lower chamber, $ak_S$ denotes the reaction capacity coefficient ($m^3$/s) of surface decarburization, $A_S$ denotes the reaction interface area ($m^2$) of surface decarburization, $ak_B$ denotes the reaction capacity coefficient ($m^3$/s) of bubble decarburization, $A_B$ denotes the reaction interface area ($m^2$) of bubble decarburization, W denotes the amount (kg) of molten steel, and $\rho_m$ denotes the density (kg/$m^3$) of molten steel.

The reaction capacity coefficient of internal decarburization ($ak_I$) and the reaction capacity coefficient of bubble decarburization ($ak_B$) are expressed by equations (19) to (23) below.

[Math. 10]

$$ak_1 = A \cdot k \cdot 10^{(1160/T+2.003)} \cdot \left\{[C] \cdot [O] - \frac{(P + P^*_{CO})}{760} / 10^{(1160/T+2.003)}\right\} / (2 \cdot \rho_m \cdot g) \tag{19}$$

$$ak_B = A_B \cdot k_B \tag{20}$$

$$A_B = N \times \pi d_B^2 \tag{21}$$

$$N = \{G/(6.0 \times 10^4)\} / \left(\frac{1}{6}\pi \cdot d_B^3\right) \tag{22}$$

$$d_B = \left[\left(\frac{6\sigma \cdot d_0}{\rho_m \cdot g}\right)^2 + 0.248\left\{\left(\frac{G}{6.0 \times 10^4 n}\right)^2 d_0\right\}^{0.867}\right]^{1/6} \tag{23}$$

Here, A denotes the cross-sectional area ($m^2$) of the lower chamber, k denotes the bubble generation rate constant of CO gas (=2×1/s), T denotes the temperature (K) of molten steel, [C] denotes the carbon concentration (mass %) in molten steel, [O] denotes the oxygen concentration (mass %) in molten steel, P denotes pressure (torr) in the vacuum chamber, $P_{CO}$* denotes the bubble generation limit pressure of CO gas (=15 torr), $\rho_m$ denotes the density (kg/$m^3$) of molten steel, g denotes the gravitational acceleration (m/$s^2$), $A_B$ denotes the reaction interface area ($m^2$) of bubble decarburization, $k_B$ denotes the mass transfer coefficient of carbon on the molten steel side in bubble decarburization (=0.0015 m/s), N denotes the number of bubbles per unit time, de denotes the diameter (m) of the bubbles of the circulation flow gas, G denotes the flow rate (NL/min) of the circulation flow gas, σ denotes the surface tension of molten steel (=1.68 N/m), $d_0$ denotes the internal diameter (m) of the nozzles of the circulation flow-gas blowing pipe, and n denotes the number of nozzles of the circulation flow-gas blowing pipe. NL/min, which is the unit of the flow rate G of the circulation flow gas, means the volume of the gas fed per unit time in the standard state, and "N" is a symbol indicating the standard state. In addition, in the disclosed embodiments, the standard state corresponds to a temperature of 0° C. and a pressure of 1 atm.

The reaction capacity coefficient of surface decarburization ($ak_S$) is expressed by equation (24) below, and the reaction interface area ($A_s$) of surface decarburization on the right-hand side of equation (24) is calculated by using equation (4) to equation (10) below.

[Math. 11]

$$ak_s = A_s \cdot k_s \tag{24}$$

[Math. 12]

$$A_s = \alpha \times \prod \tag{4}$$

$$\prod = (A_{NA} + \beta A_A) \cdot \varepsilon_Q^{1/2} / (W/1000) \tag{5}$$

$$\varepsilon_Q = Q \cdot v^2 / 2W \tag{6}$$

$$Q = 190 \times G^{1/3} \times D^{4/3} \times \{\ln(P_0/P)\}^{1/3} \tag{7}$$

$$v = \frac{Q}{\rho_m} \times \frac{1}{\pi(D/2)^2} \tag{8}$$

$$\beta = \gamma \times \frac{P_{CO}}{760} \times 10^{-(1160/T+2.003)} \tag{9}$$

$$P_{CO} = P \times \left\{\left(c_{CO_gas} + c_{CO_2_gas} \times \frac{28}{44}\right) \times \frac{1}{100 - c_{O_gas}}\right\} \tag{10}$$

Here, $A_S$ denotes the reaction interface area ($m^2$) for surface decarburization, $k_S$ denotes the mass transfer coefficient of carbon on the molten steel side in surface decarburization (=0.0015 m/s), Π denotes a surface reaction rate factor, α denotes a constant (3 to 15), $A_{NA}$ denotes an area ($m^2$) calculated by subtracting the cross-sectional area of the up-leg snorkel from the cross sectional area of the lower chamber, β denotes a liquidus surface activity coefficient, $A_A$ denotes the cross-sectional area ($m^2$) of the up-leg snorkel, $\varepsilon_Q$ denotes an agitation power density (W/kg), W denotes the amount of molten steel (kg), Q denotes the circulation flow rate (kg/s) of molten steel, v denotes the injection flow velocity (m/s) of molten steel through the down-leg snorkel, G denotes the flow rate (NL/min) of the circulation flow gas, D denotes the inner diameter (m) of the up-leg snorkel, $P_0$ denotes atmospheric pressure (torr), P denotes pressure (torr) in the vacuum chamber, $\rho_m$ denotes the density ($kg/m^3$) of molten steel, γ denotes a proportional constant ($1\times10^4$ to $1\times10^5$), $P_{CO}$ denotes the partial pressure of CO gas in the atmosphere of the vacuum chamber, T denotes the temperature (K) of molten steel, $c_{CO_gas}$ denotes the CO gas concentration (mass %) in an exhaust gas, and $c_{CO2_gas}$ denotes the $CO_2$ gas concentration (mass %) in an exhaust gas.

Here, although the liquidus surface activity coefficient (β) in equation (5) is regarded as a constant fitting parameter in Non-Patent Literature 1, the inventors conducted various investigations and, as a result, found that, by calculating the liquidus surface activity coefficient (β) by using the partial pressure of CO gas ($P_{CO}$) and the temperature of molten steel (T) as expressed in equation (9), it is possible to improve the estimation accuracy of the carbon concentration in molten steel to a higher level.

Equation (9) expresses that, in a region in which the amount of CO gas generated by decarburization is large and in which the partial pressure of CO gas ($P_{CO}$) is relatively large in relation to the pressure in the vacuum chamber (P), there is an increase in the reaction interface area of surface decarburization (As) due to agitation caused by CO gas bubbles generated. The value of the liquidus surface activity coefficient (β) is updated at predetermined intervals while the rimmed decarburization treatment is performed by using operation data which are sent to the storage-arithmetic device 17 from moment to moment while the rimmed decarburization treatment is performed.

By substituting the reaction capacity coefficient of internal decarburization ($ak_I$), the reaction capacity coefficient of bubble decarburization ($ak_B$), and the reaction capacity coefficient of surface decarburization ($ak_S$), which are derived as described above, into equation (18), the decarburization rate constant (K) is derived. This decarburization rate constant (K) is updated at predetermined intervals in time with the update of the liquidus surface activity coefficient (β) described above while the treatment is performed.

The carbon concentration in molten steel while the rimmed decarburization treatment is performed is estimated as described above, and a determination is made about the time when the rimmed decarburization treatment is ended based on a change over time in the estimated carbon concentration in molten steel while the rimmed decarburization treatment is performed. Specifically, after a change over time in the calculated, that is, estimated, carbon concentration in molten steel while the rimmed decarburization treatment is performed has indicated that the carbon concentration is equal to or lower than a target value, the rimmed decarburization treatment, that is, vacuum decarburization refining, is ended by adding a deoxidizing agent such as metal aluminum to the molten steel 3.

Here, although one example in which the disclosed embodiments is used for a vacuum degassing refining method utilizing an RH vacuum degasser 1 has been described, the decarburizing refining method for molten steel according to the disclosed embodiments may be implemented by utilizing any of the other vacuum degassing apparatuses such as a DH vacuum degasser, a REDA vacuum degasser, a VAD vacuum refining apparatus, or the like.

As described above, according to the disclosed embodiments, when decarburization refining is performed on molten steel by using a vacuum degassing apparatus, since it is possible to accurately estimate the carbon concentration in molten steel and to thereby make a determination about the time when decarburization is ended at an appropriate time, it is possible to decrease the time required to perform vacuum decarburization refining.

Examples

A test in which 300 tons of molten steel obtained by steel making by performing decarburization refining on pig iron by using a converter was tapped from the converter to a ladle and in which the molten steel in the ladle was subjected to vacuum degassing refining by using an RH vacuum degasser was performed. The steel grade which was subjected to decarburization refining was an ultralow-carbon steel grade whose standard upper limit of carbon content was 25 mass ppm. In vacuum decarburization refining, an oxygen-blowing decarburization treatment, in which oxygen gas was blown through a top-blowing lance onto the molten steel, was performed first, and a rimmed decarburization treatment, in which a decarburization treatment was performed under reduced pressure after not only the blowing of oxygen gas through the top-blowing lance but also the feeding of oxygen sources such as iron oxides to the molten steel had been stopped, was performed thereafter.

The chemical composition of the molten steel used in the test contained carbon: 0.01 mass % to 0.06 mass %, silicon: 0.015 mass % to 0.025 mass %, manganese: 0.1 mass % to 0.3 mass %, phosphorus: 0.02 mass % or less, and sulfur: 0.003 mass % or less (before the treatment in the RH vacuum degasser was performed), and the temperature of the molten steel before vacuum degassing refining was performed was 1600° C. to 1650° C. The degree of vacuum achieved in the vacuum chamber was 0.5 torr to 1.0 torr (0.067 kPa to 0.133 kPa), argon gas was used as a circulation flow gas, and the flow rate of argon gas was 2000 NL/min to 2200 NL/min.

In addition, the carbon concentration in molten steel $[C]_0'$ after the oxygen-blowing decarburization treatment had been performed was derived by using the analyzed value of the carbon concentration in molten steel taken before the RH treatment was started and by using equations (1) to (3), and a change over time in the carbon concentration in molten steel while the rimmed decarburization treatment was performed was estimated by substituting the obtained carbon concentration in molten steel $[C]_0'$ into the decarburization model formulae expressed by equations (14) to (17). Here, ζ was assigned a value of 0.8.

Here, as the thickness of slag $d_s$, a value measured by using the direct measuring method, in which a bar was submerged in molten steel, was used. The oxygen content in slag was determined by using the values of the FeO concentration and the MnO concentration in slag which were directly measured by using a solid electrolyte sensor in example 1, and by using the mass concentrations of FeO, MnO, $Al_2O_3$, $SiO_2$, and $TiO_2$ in a taken slag sample which were measured by using X-ray fluorescence spectrometry in example 2 and example 3. Here, each of the masses of such oxides was determined by conversion from the mass of the corresponding metal element in the slag sample which was measured by using X-ray fluorescence spectrometry under the assumption that the oxide of each of the metal elements had one form.

In addition, as the decarburization rate constant (K) in equation (14) which was used to estimate a change over time in the carbon concentration while the rimmed decarburization treatment was performed, an average value of past records was used in example 2, and a value obtained by substituting the reaction capacity coefficients ($ak_I$, $ak_S$, and $ak_B$), which were obtained by using equations (4) to (10) and equations (19) to (24), into equation (18) was used in example 3. Here, in equations (4) to (10) and equations (19) to (24), the parameters which varied during operations were updated at intervals of 2 seconds by using operation data sent to the storage-arithmetic device from moment to moment. The constant $\alpha$ in equation (4) was set to be 0.65 based on past operation records, and the proportional constant $\gamma$ in equation (9) was set to be $4.5\times10^5$ based on the past operation records.

The target carbon concentration was set to be 20 mass ppm, and a treatment in which metal aluminum was added to the molten steel at the time when the estimated carbon concentration was lower than the target carbon concentration so that the vacuum decarburization refining was ended was performed for 100 heats in each of examples 1, 2, and 3 and comparative examples 1 and 2. After the estimation had been performed by using the methods according to the disclosed embodiments in the case of group A consisting of examples 1, 2, and 3, by using a carbon mass balance in an exhaust gas in the case of group B consisting of comparative example 1, and by using the decarburization estimation model formulae expressed by equations (14) to (17) in the case of group C consisting of comparative example 2, a difference between the estimated $\Delta C$ and the actual $\Delta C$ after vacuum degassing refining had been performed, which was obtained by taking a molten steel sample from the ladle at the time when vacuum decarburization refining was ended and by analyzing the taken molten steel sample was derived for each of the heats, and the standard deviation $\sigma$ of the estimation errors of $\Delta C$ was derived for each of the examples and the comparative examples. The obtained standard deviations $\sigma$ are given in Table 1.

TABLE 1

| | Example 1 | Example 2 | Example 3 | Comparative Example 1 | Comparative Example 2 |
|---|---|---|---|---|---|
| Standard Deviation $\sigma$ (mass ppm) | 2.3 | 1.9 | 1.7 | 4.1 | 3.4 |

Since the standard deviations of examples 1, 2, and 3 were smaller than those of comparative examples 1 and 2, it was clarified that there was an improvement in the estimation accuracy of $\Delta C$. In addition, the estimation accuracy of each of examples 2 and 3, in which a consideration was given to oxygen contained in not only FeO and MnO contained in slag but also $Al_2O_3$, $SiO_2$, and $TiO_2$ contained in slag, was higher than that of example 1.

Moreover, based on a comparison between examples 2 and 3, the estimation accuracy of example 3, in which the decarburization rate constant (K) used to estimate a change over time in carbon concentration while the rimmed decarburization treatment was performed was updated at intervals of 2 seconds based on operation data sent to the storage-arithmetic device from moment to moment, was higher than that of example 2, in which the average value of the past records of the decarburization rate constant (K) was used.

The invention claimed is:

1. A decarburization refining method for molten steel under reduced pressure, the method comprising:

an oxygen-blowing decarburization treatment of blowing an oxidizing gas onto molten steel under reduced pressure to perform a first decarburization treatment; and a rimmed decarburization treatment of (i) stopping feeding of oxygen sources including the oxidizing gas to the molten steel after the oxygen-blowing decarburization treatment has been performed and (ii) performing a second decarburization treatment under reduced pressure until a carbon concentration in the molten steel becomes equal to or lower than a target value, wherein, in a heat for which the decarburization refining method is performed, by using operation data taken at a time when the oxygen-blowing decarburization treatment is started and at a time when the oxygen-blowing decarburization treatment is ended, an amount of carbon removed while the oxygen-blowing decarburization treatment is performed is estimated, based on the estimated amount of carbon removed while the oxygen-blowing decarburization treatment is performed, the carbon concentration in the molten steel at a time when the rimmed decarburization treatment is started is estimated, by using the estimated value as the carbon concentration in the molten steel at the time when the rimmed decarburization treatment is started, a change over time in the carbon concentration in the molten steel while the rimmed decarburization treatment is performed in the relevant heat is calculated, and based on the calculated change over time in the carbon concentration in the molten steel while the rimmed decarburization treatment is performed, a determination is made about a time when the rimmed decarburization treatment is ended.

2. The decarburization refining method for molten steel under reduced pressure according to claim 1, wherein the rimmed decarburization treatment is ended when the calculated value of the change over time in the carbon concentration in the molten steel while the rimmed decarburization treatment is performed becomes equal to or lower than the target value of the carbon concentration in the molten steel.

3. The decarburization refining method for molten steel under reduced pressure according to claim 1, wherein the amount of carbon removed while the oxygen-blowing decarburization treatment is performed is estimated based on an oxygen budget while the oxygen-blowing decarburization treatment is performed in the heat, wherein the oxygen budget is a difference between an amount of incoming oxygen and an amount of outgoing oxygen.

4. The decarburization refining method for molten steel under reduced pressure according to claim 3, wherein the amount of incoming oxygen and the amount of outgoing oxygen are estimated from at least an amount of oxygen gas contained in the oxidizing gas fed while the oxygen-blowing decarburization treatment is performed in the heat, a change in an oxygen content in the molten steel between before and after the oxygen-blowing decarburization treatment is performed, and a change in an oxygen content in slag between before and after the oxygen-blowing decarburization treatment is performed.

5. The decarburization refining method for molten steel under reduced pressure according to claim 4, wherein the change in the oxygen content in slag between before and after the oxygen-blowing decarburization treatment is performed is estimated from a measured value of an oxygen potential of the slag and a measured value of a thickness of the slag taken before the oxygen-blowing decarburization treatment is started and a measured value of an oxygen potential of the slag and a measured value of a thickness of the slag taken after the oxygen-blowing decarburization treatment has ended.

6. The decarburization refining method for molten steel under reduced pressure according to claim 1, wherein the amount of carbon removed while the oxygen-blowing decarburization treatment is performed is estimated using equations (1) to (3) below:

$$1 = (\Delta O_C + \Delta O_O + \Delta O_S + \zeta O_{Exh})/F_{O_2} \quad (1)$$

$$O_{Exh} = G_{CO_2} \times \frac{16}{44} + G_{O_2} \quad (2)$$

$$\Delta C = \Delta O_C \times \frac{12}{16} \quad (3)$$

where $\Delta O_C$ denotes an amount of oxygen (kg) which contributes to decarburizing the molten steel while the oxygen-blowing decarburization treatment is performed, $\Delta O_O$ denotes a change in an amount of dissolved oxygen (kg) in the molten steel while the oxygen-blowing decarburization treatment is performed, $\Delta O_S$ denotes a change in an amount of oxygen (kg) in slag while the oxygen-blowing decarburization treatment is performed, $O_{Exh}$ denotes an amount of oxygen (kg) which is fed and thereafter discharged into an exhaust system in a form of oxygen or carbon dioxide while the oxygen-blowing decarburization treatment is performed, $F_{O2}$ denotes an amount of oxygen (kg) which is fed while the oxygen-blowing decarburization treatment is performed, $G_{CO2}$ denotes an amount of carbon dioxide (kg) in an exhaust gas while the oxygen-blowing decarburization treatment is performed, $G_{O2}$ denotes an amount of oxygen (kg) in an exhaust gas while the oxygen-blowing decarburization treatment is performed, $\Delta C$ denotes an amount of carbon (kg) removed from the molten steel while the oxygen-blowing decarburization treatment is performed, and $\zeta$ denotes a correction factor (–) of an exhaust gas flow rate.

7. The decarburization refining method for molten steel under reduced pressure according to claim 1, wherein, while the rimmed decarburization treatment is performed, the change over time in the carbon concentration in the molten steel is calculated by using calculation parameters including at least a reaction interface area for surface decarburization, and the reaction interface area for surface decarburization is derived and updated based on operation data taken from moment to moment while the rimmed decarburization treatment is performed.

8. The decarburization refining method for molten steel under reduced pressure according to claim 7, wherein at least a CO concentration in an exhaust gas is used as the operation data taken from moment to moment for deriving the reaction interface area for surface decarburization while the rimmed decarburization treatment is performed.

9. The decarburization refining method for molten steel under reduced pressure according to claim 7, wherein at least a CO concentration in an exhaust gas, a $CO_2$ concentration in the exhaust gas, an $O_2$ concentration in the exhaust gas, and a temperature of the molten steel are used as the operation data taken from moment to moment for deriving the reaction interface area for surface decarburization while the rimmed decarburization treatment is performed.

10. The decarburization refining method for molten steel under reduced pressure according to claim 9, wherein the reaction interface area for surface decarburization while the rimmed decarburization treatment is performed is derived using equations (4) to (10) below:

$$A_s = \alpha \times \prod \quad (4)$$

$$\prod = (A_{NA} + \beta A_A) \cdot \varepsilon_Q^{1/2} / (W/1000) \quad (5)$$

$$\varepsilon_Q = Q \cdot v^2 / 2W \quad (6)$$

$$Q = 190 \times G^{1/3} \times D^{4/3} \times \{\ln(P_0/P)\}^{1/3} \quad (7)$$

$$v = \frac{Q}{\rho_m} \times \frac{1}{\pi (D/2)^2} \quad (8)$$

$$\beta = \gamma \times \frac{P_{CO}}{760} \times 10^{-(1160/T+2.003)} \quad (9)$$

$$P_{CO} = P \times \left\{ \left( c_{CO_gas} + c_{CO_2_gas} \times \frac{28}{44} \right) \times \frac{1}{100 - c_{O_gas}} \right\} \quad (10)$$

where $A_S$ denotes a reaction interface area ($m^2$) for surface decarburization, II denotes a surface reaction rate factor, $\alpha$ denotes a constant (3 to 15), $A_{NA}$ denotes an area ($m^2$) calculated by subtracting a cross-sectional area of an up-leg snorkel from a cross sectional area of a lower chamber, $\beta$ denotes a liquidus surface activity coefficient, $A_A$ denotes a cross-sectional area ($m^2$) of an up-leg snorkel, $\varepsilon_Q$ denotes an agitation power density (W/kg), W denotes an amount of the molten steel (kg), Q denotes a circulation flow rate (kg/s) of the molten steel, v denotes an injection flow velocity (m/s) of the molten steel through a down-leg snorkel, G denotes a flow rate (NL/min) of a circulation flow gas, D denotes an inner diameter (m) of an up-leg snorkel, $P_0$ denotes atmospheric pressure (torr), P denotes pressure (torr) in a vacuum chamber, $\rho_m$ denotes a density ($kg/m^3$) of the molten steel, $\gamma$ denotes a proportional constant ($1\times10^4$ to $1\times10^5$), $P_{CO}$ denotes a partial pressure of CO gas in an atmosphere of a vacuum chamber, T denotes a temperature (K) of the molten steel, $c_{CO_gas}$ denotes a CO gas concentration (mass %) in an exhaust gas, and $c_{CO2_gas}$ denotes a $CO_2$ gas concentration (mass %) in the exhaust gas.

* * * * *